United States Patent [19]

Simonoff

[11] 4,219,140

[45] Aug. 26, 1980

[54] DISPLAY HOLDER

[75] Inventor: Ely Simonoff, Chicago, Ill.

[73] Assignee: Opelika Manufacturing Corporation, Chicago, Ill.

[21] Appl. No.: 32,542

[22] Filed: Apr. 23, 1979

[51] Int. Cl.[3] ..... A47J 51/08

[52] U.S. Cl. ..... 223/87; 206/294; 206/806

[58] Field of Search ..... 223/87, 85, 95, 96, 223/88, DIG. 1, DIG. 2; 211/13, 16, 6, 113; 206/806, 294

[56] References Cited

U.S. PATENT DOCUMENTS

| | | | |
|---|---|---|---|
| 2,349,200 | 5/1944 | Ringler | 223/87 |
| 3,005,946 | 11/1962 | Berkow | 223/87 X |
| 3,243,087 | 3/1966 | Pulitzer | 223/87 |
| 3,246,812 | 4/1966 | Walker et al. | 223/87 |
| 3,650,442 | 3/1972 | Berns et al. | 223/87 |
| 3,899,078 | 8/1975 | Ambrozetes et al. | 223/87 X |

FOREIGN PATENT DOCUMENTS

| | | | |
|---|---|---|---|
| 1078507 | 8/1967 | United Kingdom | 223/87 |

*Primary Examiner*—Werner H. Schroeder
*Assistant Examiner*—Andrew M. Falik
*Attorney, Agent, or Firm*—Hume, Clement, Brinks, Willian & Olds, Ltd.

[57] ABSTRACT

A display support or header for a textile product. The header comprises a piece of thin cardboard or the like folded at its midpoint. Tabs die cut out of the sides of the header support the product, which passes through the slob formed by the die cuts. Edge flaps on the sides fold inwardly of the sides, under the product, to cooperate with the tabs in locking the product in the header.

4 Claims, 5 Drawing Figures

DISPLAY HOLDER

FIELD OF THE INVENTION

This invention pertains to a display support, or "header," which supports a textile product. More particularly, it relates to a display header which supports a textile product without staples and acts as a hanger in advantageously displaying the product.

BACKGROUND OF THE INVENTION

The present invention is an improvement over that illustrated and described in U.S. Pat. No. 3,650,442, assigned to the same assignee as the present invention. It is, in effect, an improved display header or holder for a textile product.

The display header illustrated and described in the above-mentioned U.S. patent was a substantial advance in the art of product packaging and display. The prior art headers which it replaced employed staples to attach and hold the product to the header. The patented display header was the first to successfully provide product support and proper display without the use of attaching staples.

The patented display header provided a stable and visually pleasing holder for the textile products. It was found, however, that with the header and product on a display rack, the product could be pulled out of the header too easily. It was too easy for someone to quickly pull the product from the header without removing the header from the display rack.

SUMMARY OF THE INVENTION

An object of the present invention is to provide an improved textile item display header which eliminates the need for staples and presents the product in a visually superior manner.

It is another object to provide an improved header for visually displaying a textile product which eliminates the need for staples and yet securely locks the product in place until a purchaser wants to remove it.

The foregoing and other objects are realized in accord with the invention by providing an improved textile product display header which, like its predecessor illustrated in U.S. Pat. No. 3,650,442, is fabricated of a single piece of light cardboard, paper board, or similar material, folded at its mid-point. A "J-hook" is die cut into the folded edge to provide means for actually hanging the header and the textile product on a wire or pin. Adjacent the lower edge of each side of the header a die cut slot of an improved configuration is formed. The configuration of the slot permits easy passage of a relatively thick, folded textile product. Tabs are produced when forming the die cut slots and bend inwardly to support the textile product within the header. The tabs are cut so that teeth extend upwardly and partially penetrate the product, tending to lock it in the header. Side flaps are formed on the header which fold between the sides under the textile product and cooperate in supporting it. The side flaps have upwardly extending teeth which also partially penetrate the product, assisting in locking it in the header and also enclosing the product in the header.

BRIEF DESCRIPTION OF THE DRAWINGS

The invention, including its construction and method of operation, together with additional objects and advantages thereof, is illustrated more or less diagramatically in the drawings, in which.

DESCRIPTION OF THE PREFERRED EMBODIMENT

Figure 1:
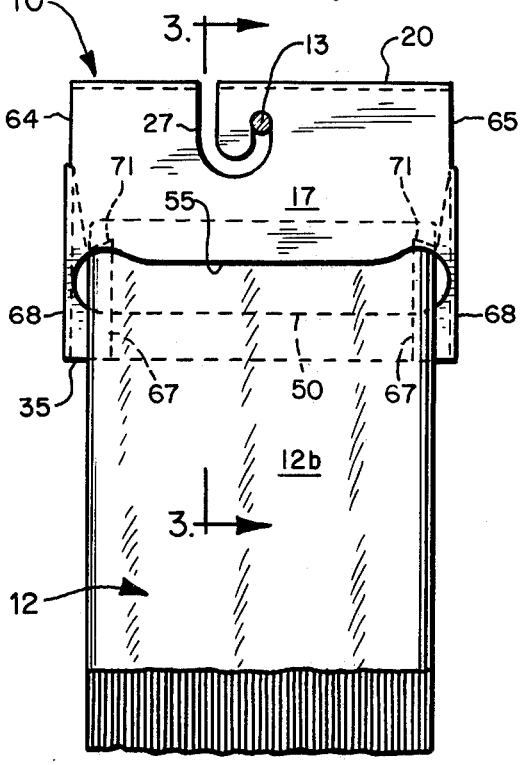
FIG. 1 is a front elevational view of a textile product supported by an improved header which is the subject of the present invention.
Figure 2:
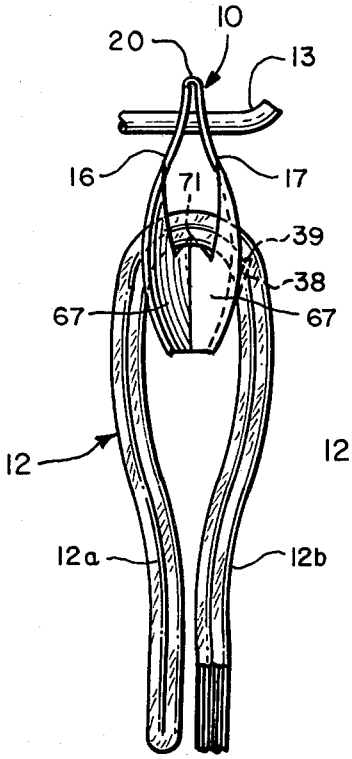
FIG. 2 is an end elevational view of the product and header illustrated in FIG. 1.
Figure 3:
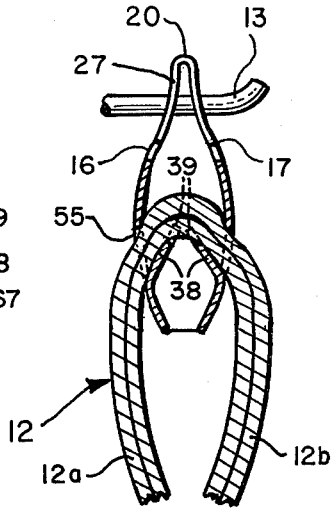
FIG. 3 is a sectional view taken along line 3—3 of FIG. 1.

Referring now to the drawings, and particularly to FIGS. 1–3, an improved textile product display support or header is illustrated generally at 10. The header 10 supports a textile product 12 such as a towel or dish cloth or the like. The header 10 supports the textile product 12 on a display stand for ready access by a purchaser, suspended from a pin 13.

The textile product 12 is neatly displayed in folded relationship and retained in the header without staples or a plastic container or the like. The improved construction of the header 10 locks the textile product 12 in and encloses it on both ends as well as the sides of the product where it passes through the header. With the enclosed header 10 the product can not be removed easily without taking the header off its mounting pin.

Figure 5:
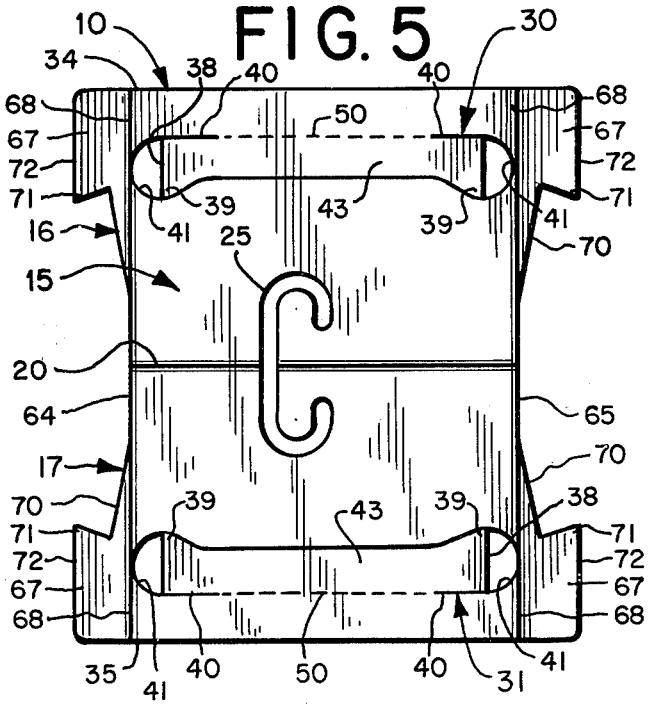
FIG. 5 is a lay-out plan view for blanking the header according to the invention.

Referring now to FIG. 5, the header 10 comprises a generally square blank 15 composed of cardboard, paper board or plastic, or the like. The blank 15 comprises two identical blank half sections 16 and 17 scored transversely along the line 20 at their mid-point to facilitate folding along that line.

A C-shaped slot 25 is formed in the center of the blank 15, extending across the center line 20 so as to be symetrically arranged on either side of the line. When the blank form 15 is folded on its center line 20 in a manner hereinafter discussed, opposite ends of the slot 25 come into alignment to define the J-hook hanger illustrated at 27 in FIG. 1. The J-hook hanger 27 receives the supporting pin 13, as illustrated in FIG. 1, to support the header 10 and the textile product 12 on display.

As seen in FIG. 5 the blank 15 has straight end edges 34 and 35 extending parallel to each other on opposite sides of the center line 20. The side edges 64 and 65 of the blank 15 are, on the other hand, irregularly shaped so as to form a side flap 67 at each of the four corners of the blank.

Each flap 67 is attached to the main body of the blank 15 along a scored line 68 which is in alignment with the side edge (64 or 65) between the flaps on a corresponding side of the blank. Accordingly, each flap 67 can easily be folded about the scored line 68 whereby the side edge in question becomes, in effect, a continuous straight line. As shall be discussed, this takes place when the textile product is mounted in the header 10.

Each flap 67 has a downwardly inclined inner shoulder 70 adjacent the scored line 68 at which it is joined to the main body of the blank 15. The shoulder 70 in each case terminates at the base of an upwardly inclined tooth 71 adjacent the outer edge 72 of the flap 67 in question.

Identical die cuts 30 and 31 are made in the blank half sections 16 and 17, respectively, adjacent to and extending along corresponding end edges 34 and 35. The die cuts 30 and 31 are identical in configuration so their corresponding segments are identified by corresponding reference numerals. Each die cut 30 and 31 defines a die cut tab 38.

Each die cut 30 and 31 includes short, straight, free end segments 40 extending parallel to and one-half inch from the corresponding free edge 34 or 35 of the blank 15. At the outer most ends the segments 40 meet segmentally circular die cut segments 41 which curve through approximately 245° of arc. At this point, they extend into a central linear segment 43 of the die cut which interconnects the segmentally circular segments 41 and extends parallel to and one and one-eighth inches from a corresponding end edge 34 or 35.

The segmentally circular die cut segments 41 are, at their outermost extremities, tangential with the score lines 68 separating the flaps 67 from the main body of the blank 15. Immediately adjacent this point of tangency, the tab 38 is "cut off" approximately one-half way through the circle defined by the semi-segmentally circular die cut segments 41. As a result, as illustrated in FIG. 5, each end of the tab 38 has a straight end edge which terminates in an upwardly pointed tooth 39.

The shape of the tab 38 is thus that of a "canoe" with squared off ends. The bottom of the canoe between the linear segments 40 of each die cut remains attached to the major portion of the corresponding half section of the blank 15. The line of attachment of tab 38 is, in each instance, identified by the reference numeral 50.

Figure 4:
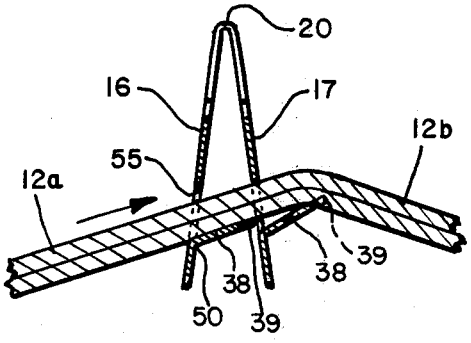
FIG. 4 is a cross-sectional view taken along the same line as that of FIG. 3, with the header shown in folded position and with the textile product being threaded through the slot in the header.

Referring now to the operation of the header 10, the first step in preparing the blank form 15 for receipt of the textile product 12 in supporting relationship is to fold the blank 15 at the center line 20 so that the half sections 16 and 17 are disposed adjacent one another generally in the relationship shown in FIG. 4. In this relationship the flaps 67 lie in the planes of the corresponding half sections 16 and 17. The tabs 38 are then bent outwardly in one direction about their attachment lines 50 so they are disposed in the manner illustrated. The hand towel or wash cloth, folded so that its width corresponds to the overall length of a tab 38, is then inserted through the slot 55 left by the outward folding of the tab until it extends an equal distance on opposite sides of each of the half sections 16 and 17 of the folded blank 15.

At this point, the header 10 is picked up by grasping opposite sides of the half sections 16 and 17 adjacent the center line 20 of the partially folded blank form 15. The opposite ends 12A and 12B of the textile product fall down into depending relationship, adjacent each other. The tabs 38 are then easily urged by hand into a position illustrated in FIG. 3, extending upwardly between the sides 16 and 17 of the blank 15. In this position, the upwardly extending tooth 39 on each end of each tab 38 partially penetrates the towel or the like. It thus tends to lock the towel into place.

The short end segments 40 of the die cuts 30 and 31 permit the tabs 38 to bend inwardly of the folded blank 15 at their opposite ends and forestall tearing of the blank. The teeth 39 at the end 41 of the tabs 38 force the textile product upwardly into the header body.

At this point the side flaps 67 are each folded inwardly between corresponding sides 16 and 17 of the blank in the manner illustrated in FIGS. 1 and 2. The tooth 71 on each flap 67 is inserted under the edge of a corresponding side of the towel now supported on the teeth 39 of the tabs 38. A crosslocking relationship is thus established between the upwardly extending teeth 71 on the flaps 67 and the upwardly extending teeth 39 on the tabs 38. The towel 12 is more firmly locked in place. At the same time when the flaps 67 are folded inwardly their inclined edges 70 force the towel where it passes through the header to stay entirely within the confines of the header. The flaps 67 serve as enclosures for the ends of the header and add lateral stability to it.

While the embodiment described herein is at present considered to be preferred, it is understood that various modifications and improvements may be made therein, and it is intended to cover in the appended claims all such modifications and improvements as fall within the true spirit and scope of the invention.

What is claimed is:

1. A display support or header for the textile product such as a hand towel or washcloth or the like, comprising:

a. body means composed of flexible sheet material,
b. said body means including normally planar side wall sections disposed in side-by-side relationship,
c. horizontally elongated tab means formed out of and adjacent the corresponding lower end edge of each side wall section,
d. each of said tab means including vertically enlarged portions at opposite ends thereof,
e. each of said tab means having horizontally extending upper and lower edges and adapted to fold outwardly of the plane of the corresponding side wall section so as to permit a textile product or the like to pass through the cutout portion left by the outwardly folded tab means from one side of said body means to the other side thereof,
f. hanger means on said body means above said tab means for hanging said header,
g. said header when hung from said hanger means adapted to support a textile product in folded relationship at a fold therein,
h. said vertically enlarged portions of said tab means defining upwardly extending teeth adapted to be disposed under and in engagement with said product at said fold,
i. each of said side wall sections including side edges intersecting corresponding lower end edges, and
j. side flap means formed on the side edge of each of said side wall sections adjacent a corresponding intersection and adapted to fold between said side wall sections to a position under said product,
k. each of said side flap means comprising a horizontally extending flap connected to the corresponding side wall section along a vertical score line,
l. said flaps having upwardly extending teeth which engage said product at said fold.

2. The display support or header of claim 1 further characterized in that:

a. said teeth on said vertically enlarged portions of said tab means cooperate with said teeth on said flaps to lock the product in said header.

3. The display support or header of claim 2 further characterized in that:

a. each of said flaps includes an inclined ramp edge which engages the side of the product when the flap is folded under the product to force the product inwardly of the side edges of the side wall sections.

4. The display support or header of claim 2 further characterized in that:

a. said tab means each have lower edges connected to said side wall sections whereby said tab means fold downwardly as they are folded inwardly of said side wall sections, b. opposite end segments of the lower edge of each of said tab means being free of corresponding side wall sections whereby the opposite ends of each of said tab means are free to bend inwardly of said side wall sections about generally vertical as well as generally horizontal axes, c. said vertically enlarged portions of said tab means defining upwardly extending teeth by being cut off along vertical edges from their outside edge.

* * * * *